US012262773B2

(12) United States Patent
Sawabe et al.

(10) Patent No.: US 12,262,773 B2
(45) Date of Patent: Apr. 1, 2025

(54) HARNESS BRACKET AND HELMET

(71) Applicant: SHOEI CO., LTD., Tokyo (JP)

(72) Inventors: Akira Sawabe, Tokyo (JP); Wakaba Miyamori, Tokyo (JP)

(73) Assignee: SHOEI CO., LTD., Tokyo (JP)

( * ) Notice: Subject to any disclaimer, the term of this patent is extended or adjusted under 35 U.S.C. 154(b) by 0 days.

(21) Appl. No.: 18/253,259

(22) PCT Filed: Aug. 12, 2021

(86) PCT No.: PCT/JP2021/029778
§ 371 (c)(1),
(2) Date: May 17, 2023

(87) PCT Pub. No.: WO2022/158014
PCT Pub. Date: Jul. 28, 2022

(65) Prior Publication Data

US 2024/0016251 A1 Jan. 18, 2024

(30) Foreign Application Priority Data

Jan. 19, 2021 (JP) ..... 2021-006413

(51) Int. Cl.
*A42B 3/12* (2006.01)
*A42B 3/08* (2006.01)

(52) U.S. Cl.
CPC ..... *A42B 3/127* (2013.01); *A42B 3/08* (2013.01)

(58) Field of Classification Search
CPC .. A42B 3/04; A42B 3/30; A42B 3/127; A42B 3/08; A42B 3/0406; A42B 3/085; A42B 3/303; A42B 3/306
See application file for complete search history.

(56) References Cited

U.S. PATENT DOCUMENTS 5,090,061 A * 2/1992 Kamata ..... A42B 3/16 2/423
5,136,657 A * 8/1992 Hattori ..... A42B 3/127 379/430
6,256,797 B1 * 7/2001 Nemoto ..... A42B 3/328 2/424
6,421,841 B2 * 7/2002 Ikeda ..... A42B 3/127 2/414

(Continued)

FOREIGN PATENT DOCUMENTS

JP 2018115410 A 7/2018

OTHER PUBLICATIONS

International Search Report for International Application No. PCT/JP2021/029778, Filing Date Aug. 12, 2021, Date of Mailing Sep. 21, 2021, 3 pages.

*Primary Examiner* — F Griffin Hall
(74) *Attorney, Agent, or Firm* — CANTOR COLBURN LLP

(57) ABSTRACT

A harness bracket is configured to be attached to a helmet body of a helmet. The harness bracket includes a base attached to the helmet body. The base includes a first support that supports a harness, a second support that supports a liner, and a third support that supports a cheek pad. The first support is configured to position the harness on the base. The second support is configured to position the liner on the base. The third support is configured to position the cheek pad on the base.

9 Claims, 5 Drawing Sheets

(56) References Cited

U.S. PATENT DOCUMENTS

| | | | | |
|---|---|---|---|---|
| 7,207,071 | B2 * | 4/2007 | Pierce | A42B 3/281 2/424 |
| 7,854,023 | B2 * | 12/2010 | Ando | A42B 3/127 2/424 |
| 8,239,970 | B2 * | 8/2012 | Ikeda | A42B 3/127 24/114.4 |
| 8,549,671 | B2 * | 10/2013 | Sackett | A42B 3/127 2/414 |
| 8,800,065 | B2 * | 8/2014 | Ikeda | A42B 3/328 2/6.1 |
| 9,681,697 | B2 * | 6/2017 | Ikeda | A42B 3/142 |
| 10,342,282 | B2 * | 7/2019 | Salvetti | A42B 3/328 |
| 11,612,206 | B2 * | 3/2023 | Kim | A42B 3/127 2/414 |
| 2020/0163401 | A1 * | 5/2020 | Lee | A42B 3/328 |
| 2020/0221805 | A1 | 7/2020 | Ikeda | |
| 2023/0041919 | A1 * | 2/2023 | Nakashima | A42B 3/127 |

* cited by examiner

HARNESS BRACKET AND HELMET

TECHNICAL FIELD

The present disclosure relates to a harness bracket and a helmet.

BACKGROUND ART

A helmet for a motorcycle includes various types of interior components attached to the inner side of a helmet body such as liners, interior pads, and harnesses of electronic devices. Patent Document 1 describes cheek pads as an example of such interior pads.

The interior components of the helmet body are attached to the inner side of the helmet body by supports welded to the helmet body. Specifically, tubular liner supports welded to the helmet body are fitted into fitting holes of the liners so that the liners are positioned relative to the helmet body. The cheek pads are hooked to pad supports welded to the helmet body so that the cheek pads are positioned relative to the helmet body. Harnesses are fixed to harness brackets, which are harness supports welded to the helmet body, so that the harnesses are positioned relative to the helmet body.

CITATION LIST

Patent Literature

Patent Literature 1: Japanese Laid-Open Patent Publication No. 2018-115410

SUMMARY OF INVENTION

Technical Problem

The supports for supporting interior components are separately welded to the helmet body. In this case, the directions in which the welded supports project or the positions where the supports are welded may differ from the desired (ideal) direction or position. Thus, the supports may not be positioned relative to the supported subject at the desired (ideal) location. For example, deviation of the relative position of the harness bracket and a liner support from the desired position may result in force that is greater than the predetermined load being applied to the harness between the liner and the harness bracket when attaching the liner. Further, deviation in the relative position of the harness bracket and a pad support from the desired position may result in entrapment of the harness between the cheek pad and the harness bracket when attaching the cheek pad. As a result, attachment of the liner or the cheek pad may cause entrapment or breakage of the wiring of the harness.

Solution to Problem

A harness bracket according to one aspect of the present disclosure is attached to a helmet body of a helmet. The harness bracket includes a base attached to the helmet body. The base includes a first support that supports a harness, and the first support is configured to position the harness on the base. The base also includes a second support that supports a liner, and the second support is configured to position the liner on the base. The base also includes a third support that supports a cheek pad, and the third support is configured to position the cheek pad on the base.

A helmet according to one aspect of the present disclosure includes a helmet body and a harness bracket attached to the helmet body. The harness bracket includes a base attached to the helmet body. The base includes a first support that supports a harness, and the first support is configured to position the harness on the base. The base also includes a second support that supports a liner, and the second support is configured to position the liner on the base. The base also includes a third support that supports a cheek pad, and the third support is configured to position the cheek pad on the base.

DESCRIPTION OF EMBODIMENTS

A helmet and harness brackets according to one embodiment will now be described with reference to FIGS. 1 to 7. In FIGS. 1 to 7, the forward, rearward, leftward, rightward, upward, and downward directions as viewed from a wearer of a helmet are used as a frame of reference for the forward, rearward, leftward, rightward, upward, and downward directions of the helmet.

Helmet

Figure 1:
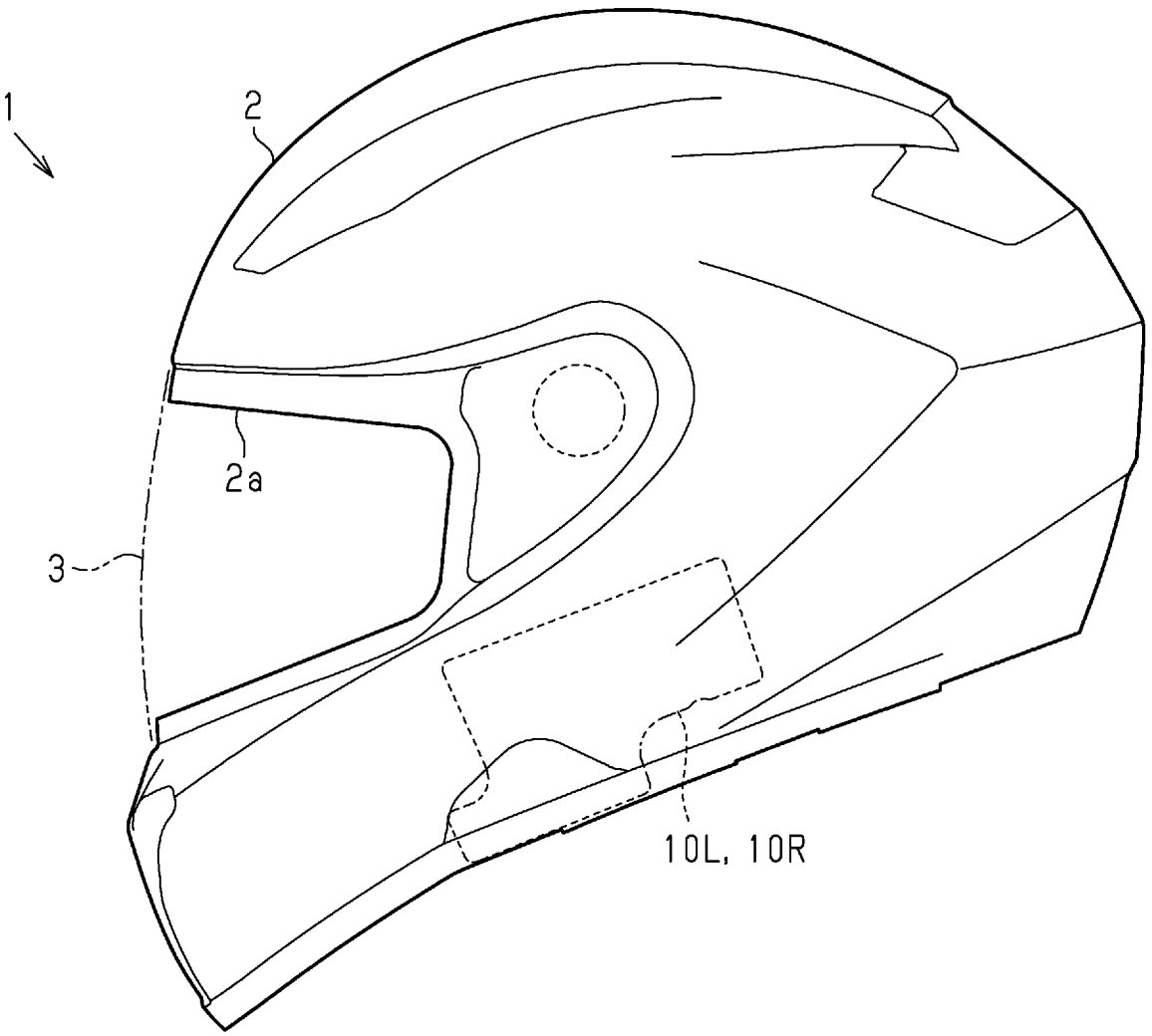
FIG. 1 is a side view of a helmet according to one embodiment.

As shown in FIG. 1, a helmet 1 is a full-face helmet. The helmet 1 includes a helmet body 2 and harness brackets 10L, 10R.

The helmet body 2 forms the shell of the helmet. The helmet body 2 is a hemispherical plastic member. The helmet body 2 is made of a material that is selected from, for example, acrylonitrile-butadiene-styrene (ABS) copolymers, polycarbonate (PC), thermosetting resin impregnated with reinforcing fibers, and the like.

The helmet body 2 includes an opening 2*a* that is open toward the front. The opening 2*a* obtains a field of view of a wearer. A shield 3 serving as a light-transmissive plate member may be arranged in the opening 2*a*. The shield 3 prevents foreign material, rainwater, or wind flying from the front from entering the helmet 1 and improves visibility for the wearer.

The harness brackets 10L, 10R are components that support harnesses connected to electronic devices installed in the helmet 1. The harness brackets 10L, 10R are attached to the left and right sides of the inner surface of the helmet body 2 in correspondence with the cheeks of the wearer. The harness bracket 10L is located at the left side of the wearer of the helmet 1. The harness bracket 10R is located at the right side of the wearer of the helmet 1.

Figure 2:
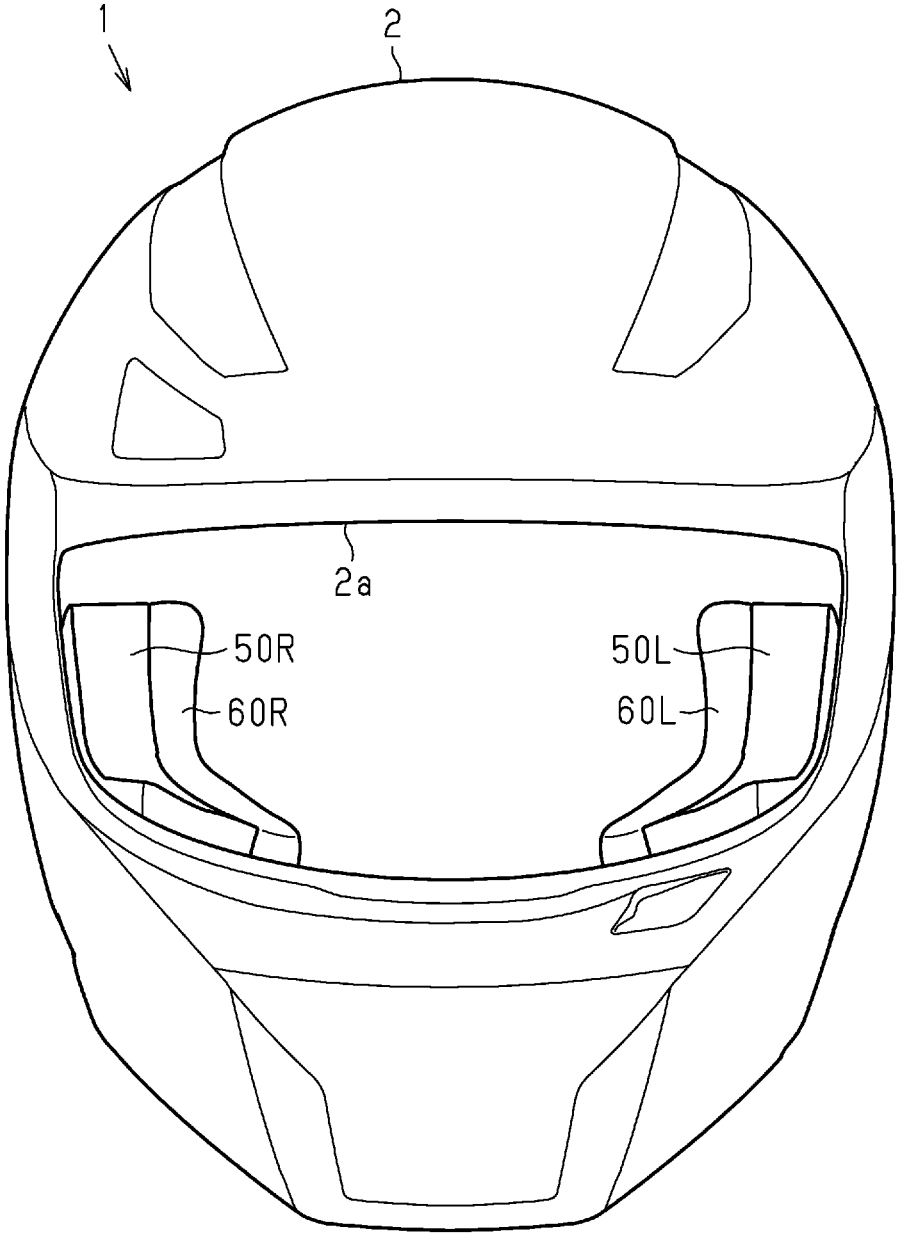
FIG. 2 is a front view of the helmet of FIG. 1.

As shown in FIG. 2, the helmet body 2 includes left and right liners 50L, 50R, which are interior members that absorb impact. The liner 50L is attached to the inner surface of the harness bracket 10L. The liner 50R is attached to the inner surface of the harness bracket 10R.

The liners 50L, 50R are made of, for example, resin foam such as styrene foam. The liners 50L, 50R are shaped in conformance with the inner surface of the helmet body 2 and plane-symmetrical to each other. In addition to the liners 50L, 50R, the helmet 1 may include liners at the back of the head and the top of the head so that the entire head is covered.

The helmet body 2 includes left and right cheek pads 60L, 60R, which are interior pads. The cheek pads 60L, 60R abut the cheeks of the wearer to increase contact between the helmet 1 and the wearer and improve the wearing comfort. The cheek pads 60L, 60R are plane-symmetrical to each other. The cheek pads 60L, 60R are arranged at the inner sides of the liners 50L, 50R in the helmet body 2. The cheek pad 60L is fixed to the liner 50L, the harness bracket 10L, and the helmet body 2. Likewise, the cheek pad 60R is fixed to the liner 50R, the harness bracket 10R, and the helmet body 2.

In addition to the cheek pads 60L, 60R, the helmet 1 may include various types of interior pads such as a front pad abutting the forehead, a rear pad abutting the back of the head, side pads abutting the sides of the head, and a top pad abutting the top of the head. These interior pads, arranged at the inner sides of the helmet body 2, are less rigid than the liners 50L, 50R to improve cushioning for the head. The helmet 1 may also include a chin strap (not shown) that fixes, for example, the chin of the wearer to the helmet.

Harness Brackets

Figure 3:
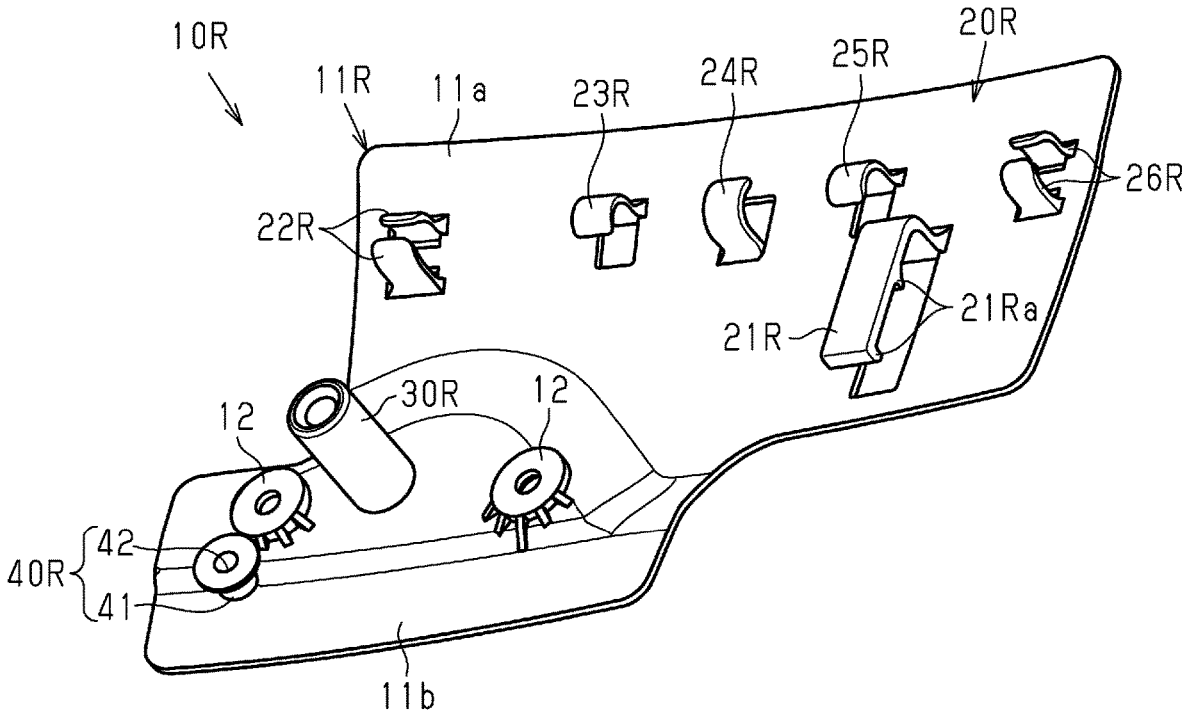
FIG. 3 is a perspective view of a harness bracket in the helmet of FIG. 1.

The harness bracket 10R will now be described with reference to FIG. 3. In FIG. 3, the left direction in the drawing is the front as viewed from the wearer of the helmet 1, and the right direction in the drawing is the rear as viewed from the wearer of the helmet 1.

As shown in FIG. 3, the harness bracket 10R includes a base 11R. The base 11R has the shape of a plate curved three-dimensionally in conformance with the inner surface of the helmet body 2. The base 11R is S-shaped as viewed from a viewpoint opposed to the inner surface of the base 11R. The base 11R includes an upper region 11*a*, which is a rectangular plate, and a lower region 11*b* that extends frontward from the lower front portion of the upper region 11*a*. The width of the upper region 11*a* is greater than the width of the lower region 11*b* in the vertical direction. The lower region 11*b* is integrated with the upper region 11*a* and arranged inward from the upper region 11*a* in the right-left direction of the helmet body 2.

The base 11R includes fixing portions 12 having threaded holes. When the outer surface of the base 11R abuts the inner surface of the helmet body 2, the fixing portions 12 are fastened by screws to the helmet body 2 so that the harness bracket 10R is fixed to the helmet body 2. The means for fixing the harness bracket 10R to the helmet body 2 does not need to be screws. For example, any type of fixing agent such as hot melt or a fixing means such as double-sided tape may be used to attach the harness bracket 10R to the helmet body 2.

The upper region 11*a* of the harness bracket 10R includes a harness support 20R, which is an example of a first support. The harness support 20R includes a connection member support 21R and wire supports 22R to 26R. The connection member support 21R and the wire supports 22R to 26R are arranged on the inner surface of the upper region 11*a*.

The connection member support 21R supports a connection member of a harness connected to an electronic device installed in the helmet 1. In one example, the connection member of the harness is a relay connector that electrically connects wires. The connection member support 21R is located at the lower rear portion of the upper region 11*a*. The lower region 11*b* is not located downward from the connection member support 21R. The lower region 11*b* is entirely located frontward from the connection member support 21R in the front-rear direction. The connection member support 21R is hook-shaped to project inward from the inner surface of the upper region 11*a* and extend downward in the helmet body 2. The connection member support 21R includes two holding projections 21Ra. The connection member support 21R holds a connection member between the two holding projections 21Ra and presses the connection member against the inner surface of the upper region 11*a* so that the connection member is positioned relative to the base 11R.

The wire supports 22R to 26R support a wire of the harness connected to the electronic device installed in the helmet 1. The wire supports 22R to 26R are arranged at the same height in a portion of the upper region 11*a* upward from the connection member support 21R. The wire supports 22R to 26R are aligned in order of the wire supports 22R, 23R, 24R, 25R, and 26R from the front to the rear.

The wire support 22R is arranged at the front end of the upper region 11*a*. The wire support 22R includes two support pieces arranged in the vertical direction that project inward from the upper region 11*a* and curve toward each other in the helmet body 2. The wire support 22R sandwiches a wire so that the wire is positioned relative to the base 11R. The wire support 26R arranged at the rear end of the upper region 11*a* has the same structure as the wire support 22R.

The wire supports 23R to 25R are arranged on the central portion of the upper region 11*a* in the front-rear direction. The wire supports 23R, 25R are support pieces that project inward from the upper region 11*a* and curve downward in the helmet body 2. The wire support 24R is a support piece that projects inward from the upper region 11*a* and curves upward in the helmet body 2. With the wire supports 23R to 25R, the wire supports 23R, 25R support a wire from above and the wire support 24R supports the wire from below so that the wire is positioned relative to the base 11R.

The lower region 11*b* of the harness bracket 10R includes a liner support 30R, which is an example of a second support, and a pad support 40R, which is an example of a third support. The liner support 30R is tubular and projects inward from the inner surface of the lower region 11*b* in the helmet body 2.

The liner support 30R is inserted into an insertion hole 51 of the liner 50R (refer to FIG. 5) so that the liner 50R is positioned relative to the base 11R. The liner support 30R is located downward from the harness support 20R so that the liner 50R is attached at a location spaced apart from the wire that is supported by the harness support 20R. This avoids entrapment of the wire when attaching the liner 50R.

The pad support 40R is arranged downward and frontward from the liner support 30R on the lower region 11*b*. The pad support 40R includes an engaged portion 41 and an increased diameter portion 42. The engaged portion 41 is tubular and projects inward from the inner surface of the lower region 11*b* in the helmet body 2. The increased diameter portion 42 is a flange having a larger diameter than the engaged portion 41 and is arranged at the distal end of the engaged portion 41.

The engaged portion 41 is engaged with a first engagement portion 65*a* of the cheek pad 60R (refer to FIG. 6) so that the pad support 40R supports and positions the cheek pad on the base 11R. The pad support 40R is located downward from the harness support so that cheek pad 60R is attached at a location spaced apart from the wire that is supported by the harness support 20R. This avoids entrapment of the wire when attaching the cheek pad 60R.

The arrangement of the harness support 20R, the liner support 30R, and the pad support 40R on the base 11R sets the relative positions of the harness, the liner 50R, and the cheek pad 60R based on the harness bracket 10R, which is a single plastic molded article. This avoids entrapment of a wire between the liner 50R and the base 11R and entrapment of a wire between the cheek pad 60R and the base 11R when attaching the liner 50R and the cheek pad 60R. That is, entrapment of a wire of a harness is avoided.

Specifically, when a wire arranged upward from the liner support 30R sags even slightly due to its weight, the wire may become entrapped between the liner 50R and the base 11R due to the liner support 30R being arranged in an incorrect position or in an incorrect direction. Further, when a wire arranged upward from the pad support 40R sags even slightly due to its weight, the wire may become entrapped between the cheek pad 60R and the base 11R due to the pad support 40R being arranged at an incorrect position. In this respect, the harness support 20R, the liner support 30R, and the pad support 40R of which the relative positions are set based on the harness bracket 10R, which is a single plastic molded article, avoid arrangement in incorrect directions and incorrect positions. This further effectively avoids entrapment. The liner support 30R and the pad support 40R are not located downward from the connection member where wires are concentrated. This avoids entrapment of the wires concentrated at the connection member and does not apply excessive tension to the wires if the wires sag.

On the base 11R, the connection member support 21R, the liner support 30R, and the pad support 40R are arranged at different positions in the vertical direction and the front-rear direction, that is, the circumferential direction of the helmet body 2. This improves working efficiency when attaching the liner 50R and the cheek pad 60R.

The quantity of components is reduced compared to when the harness support 20R, the liner support 30R, and the pad support 40R are formed as separate components. When the harness support 20R, the liner support 30R, and the pad support 40R are formed as separate components, the components need to be separately attached to the helmet body 2. In contrast, the harness bracket 10R of the present embodiment only needs to be attached to the helmet body 2. That is, the process for manufacturing the helmet 1 is simplified.

Figure 4:
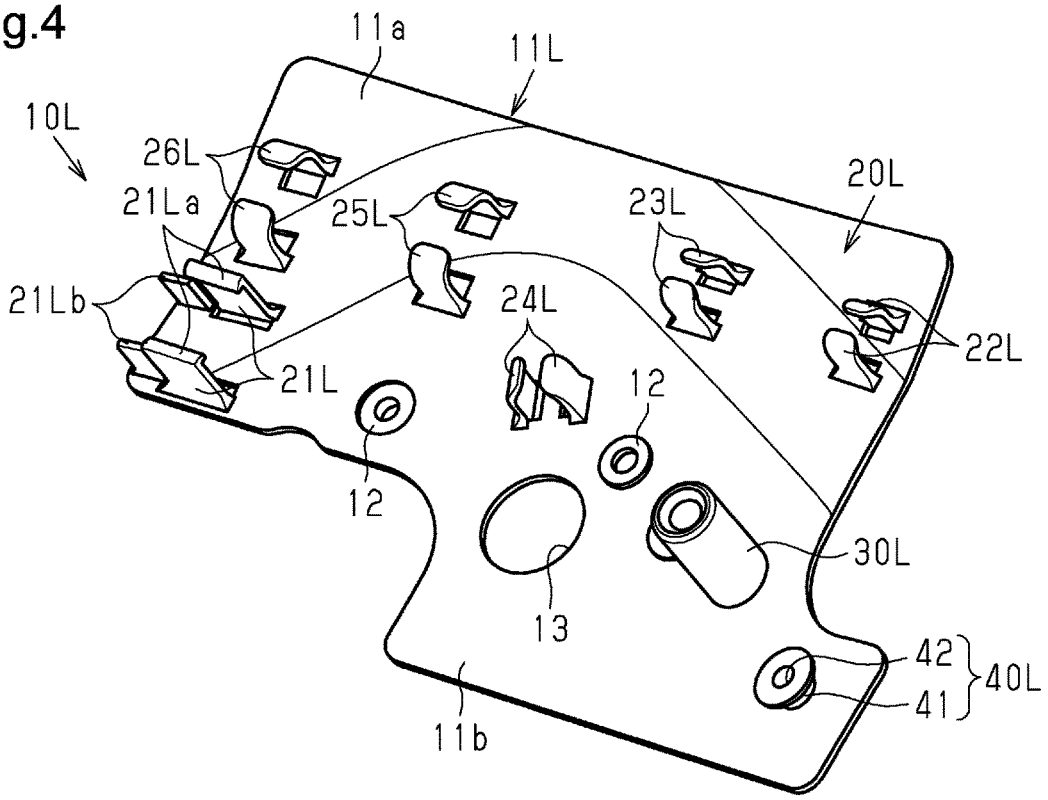
FIG. 4 is a perspective view of another harness bracket in the helmet of FIG. 1.

The harness bracket 10L will now be described with reference to FIG. 4. In FIG. 4, the right direction in the drawing is the front as viewed from the wearer of the helmet 1, and the left direction in the drawing is the rear as viewed from the wearer of the helmet 1.

As shown in FIG. 4, the harness bracket 10L includes a base 11L. The base 11L is substantially plane-symmetrical to the base 11R of the harness bracket 10R. Specifically, the base 11L has the shape of a plate curved three-dimensionally in conformance with the inner surface of the helmet body 2. The base 11L is inverted S-shaped as viewed from a viewpoint opposed to the inner surface of the base 11L. The base 11L includes the upper region 11*a* and the lower region 11*b*. In the harness bracket 10L, the lower region 11*b* is integrated with the upper region 11*a* and arranged inward from the upper region 11*a* in the right-left direction of the helmet body 2. The base 11L includes fixing portions 12 having threaded holes. The fixing portions 12 are fastened by screws to the helmet body 2 so that the harness bracket 10L is fixed to the helmet body 2.

The base 11L includes a through-hole 13 that is arranged to extend between the upper region 11*a* and the lower region 11*b*. The through-hole 13 receives a harness of an electronic device attached to, for example, the outer surface of the helmet body 2 and guides the harness to the inner side of the base 11L.

The upper region 11*a* of the harness bracket 10L includes a harness support 20L, which is an example of the first support. The harness support 20L includes a connection member support 21L and wire supports 22L to 26L. The connection member support 21L and the wire supports 22L to 26L are arranged on the inner surface of the upper region 11*a*.

The connection member support 21L supports a connection member of a harness connected to an electronic device installed in the helmet 1. The connection member support 21L is located at the lower rear portion of the upper region 11*a*. The lower region 11*b* is not located downward from the connection member support 21L. The lower region 11*b* is entirely located frontward from the connection member support 21L in the front-rear direction. The connection member support 21L includes two support walls arranged vertically and extending inward in the helmet body 2. The distal ends of the connection member support 21L include holding projections 21La. The connection member support 21L holds and sandwiches a connection member between the support walls of the connection member support 21L so that the connection member is supported and positioned relative to the base 11L.

The connection member support 21L includes two auxiliary support walls 21Lb in the vicinity of the connection member support 21L. The two auxiliary support walls 21Lb support the connection member held between the support walls of the connection member support 21L and restrict loosening of the like of the connection member.

The wire supports 22L to 26L support a wire of the harness connected to the electronic device installed in the helmet 1. The wire support 22L is arranged at the front end of the upper region 11*a*. The wire support 23L is arranged rearward from the wire support 22L at the same height as the wire support 22L. The wire supports 22L, 23L each include two support pieces arranged in the vertical direction that project inward from the upper region 11*a* and curve toward each other in the helmet body 2.

The wire support 24L is arranged upward from the through-hole 13 and downward from the wire supports 22L, 23L. The wire support 24L includes two support pieces inclined upward and rearward that project inward from the upper region 11*a* and curve toward each other in the helmet body 2. The wire support 24L supports a wire guided to the inner side of the base 11L through, for example, the through-hole 13.

The wire supports 25L, 26L each include two support pieces arranged in the vertical direction. The wire supports 25L, 26L each have a distance between the support pieces that is greater than that of the two support pieces of the wire supports 22L, 23L. The wire support 25L is arranged rearward from the wire support 24L and frontward from the wire support 26L. The wire support 26L is arranged at the rear end of the upper region 11*a*.

The two support pieces of the wire supports 25L, 26L are shaped to project inward from the upper region 11*a* and curve toward each other in the helmet body 2. The wire supports 25L, 26L collectively support, for example, a first wire supported by the wire supports 22L, 23L and a second wire supported by the wire support 24L.

The lower region 11*b* of the harness bracket 10L includes a liner support 30L, which is an example of the second support, and a pad support 40L, which is an example of the third support. The liner support 30L and the pad support 40L have the same structures as the liner support 30R and the pad support 40R and will not be described.

The arrangement of the harness support 20L, the liner support 30L, and the pad support 40L on the base 11L sets the relative positions of the harness, the liner 50L, and the cheek pad 60L in the same manner as the harness bracket 10R. This avoids entrapment of the wire of a harness when attaching the liner 50L and the cheek pad 60L.

Liner

Figure 5:
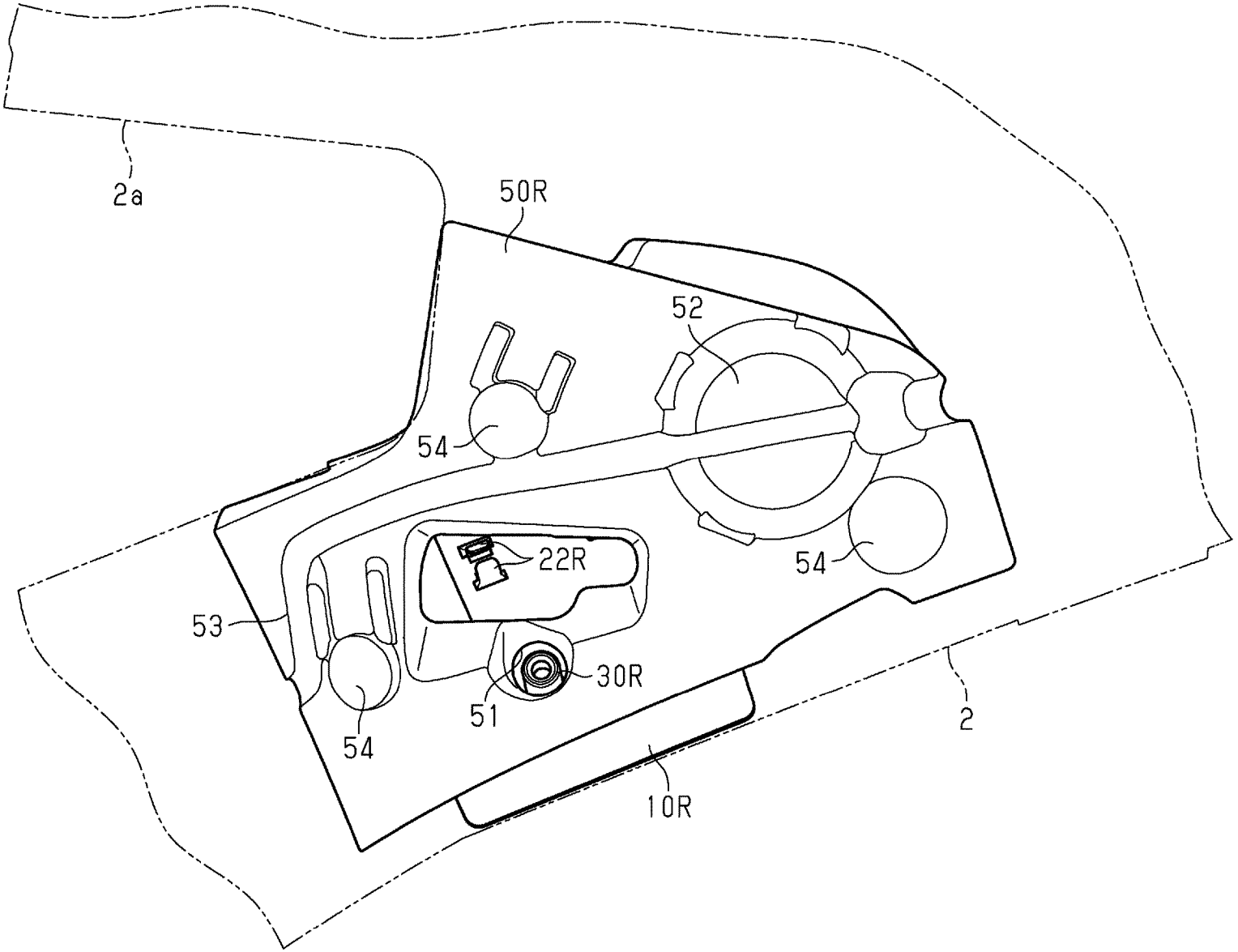
FIG. 5 is a front view of a liner attached to the harness brackets in the helmet of FIG. 1.

The liner 50R will now be described with reference to FIG. 5. The liner 50L is plane-symmetrical to the liner 50R and will not be described. In FIG. 5, the left direction in the drawing is the front as viewed from the wearer of the helmet 1 and the right direction in the drawing is the rear as viewed from the wearer of the helmet 1.

As shown in FIG. 5, the liner 50R is arranged to cover the harness bracket 10R in the helmet body 2. The liner 50R is curved in conformance with the inner surface of the helmet body 2.

The liner 50R includes the insertion hole 51 that extends through the liner 50R in the thickness direction. The insertion hole 51 is arranged at a location that corresponds to the liner support 30R of the harness bracket 10R. The liner support 30R is inserted into the insertion hole 51 so that the liner 50R is positioned relative to the base 11R.

The liner 50R includes a holder 52, a wire groove 53, and three recesses 54 in the inner surface of the liner 50R that faces the cheek pad 60R. In one example, the holder 52 is an indentation for holding an electronic device such as a loudspeaker. The wire groove 53 is a groove that extends from the side edge of the liner 50R to the holder 52. The wire of a harness is arranged in the wire groove 53. For example, male buttons (not shown) for attaching the cheek pad 60R are arranged in the recesses 54.

Cheek Pad

Figure 6:
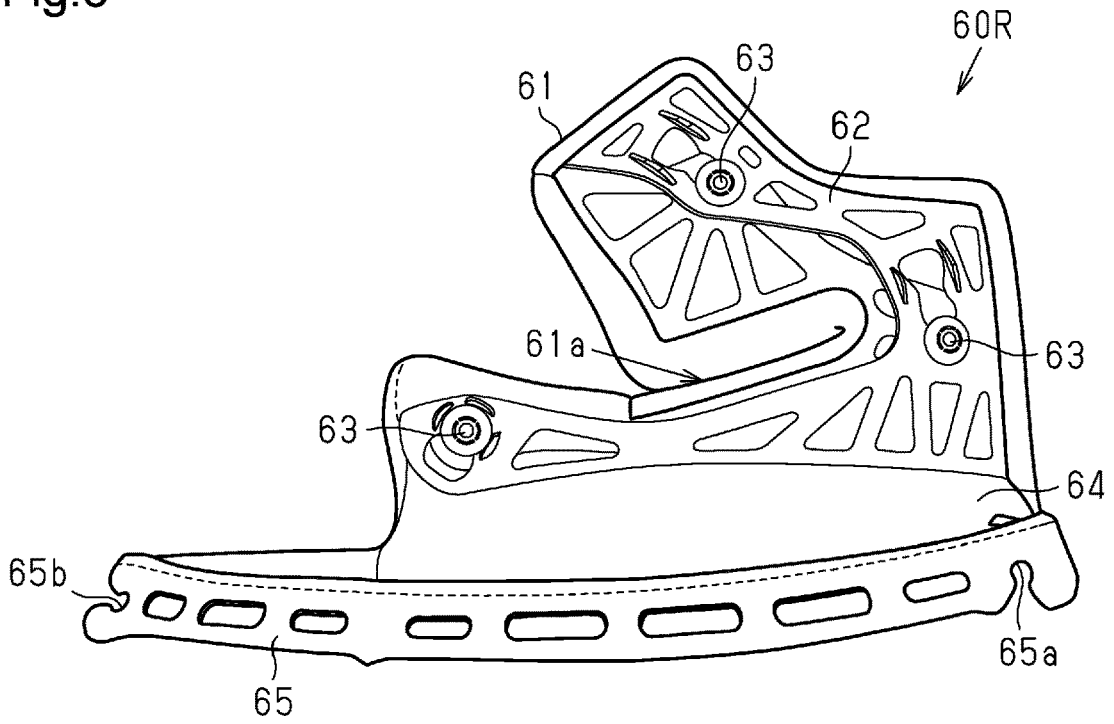
FIG. 6 is a front view of a cheek pad in the helmet of FIG. 1.

The cheek pad 60R will now be described with reference to FIG. 6. The cheek pad 60L is plane-symmetrical to the cheek pad 60R and will not be described. In FIG. 6, the right direction in the drawing is the front as viewed from the wearer of the helmet 1, and the left direction in the drawing is the rear as viewed from the wearer of the helmet 1.

As shown in FIG. 6, the cheek pad 60R includes a body 61. The body 61 includes a cushion made of, for example, urethane foam and a cover body made of, for example, fabric for covering the cushion. The body 61 is formed in conformance with the inner surface of the liner 50R. The body 61 abuts the cheek of the wearer to increase contact between the helmet 1 and the wearer. The body 61 may include a slit 61*a* into which a chin strap is inserted.

The cheek pad 60R includes a plate body 62. The plate body 62 is a flexible plastic plate for maintaining the shape of the cushion of the body 61. The plate body 62 is arranged at the surface of the body 61 opposite to the surface that abuts the cheek of the wearer. The plate body 62 is a member of the cheek pad 60R that faces the inner surface of the liner 50R.

Three female buttons 63 are attached to the body 61. The female buttons 63 project from holes formed in the plate body 62 on the surface of the body 61 that faces the liner 50R. The female buttons 63 of the cheek pad 60R are engaged with the male buttons of the liner 50R so that the body 61 is fixed to the inner side of the liner 50R. The quantity of the female buttons 63 and the male buttons of the liner 50R may each be greater than or less than three.

The cheek pad 60R includes an extended portion 64. The extended portion 64 is where the cover body of the body 61 extends at the lower portion of the surface of the body 61 that faces the liner 50R. The distal end of the extended portion 64 includes a fixing piece 65.

The fixing piece 65 is a flexible plastic member. The fixing piece 65 includes the first engagement portion 65*a* located at the front end of the fixing piece 65 and a second engagement portion 65*b* located at the rear end of the fixing piece 65. The fixing piece 65 is inserted between the helmet body 2 and the liner 50R, and the first engagement portion 65*a* is engaged with the engaged portion 41 so that the cheek pad 60R is positioned relative to the harness bracket 10R. The second engagement portion 65*b* is held by a boss-like holding portion (not shown) arranged in the helmet body 2. The fixing piece 65 arranged at the distal end of the extended portion 64, formed by the cover body such as fabric, is allowed to be inserted between the helmet body 2 and the liner 50R from the extended portion 64.

Operation of Embodiment

Figure 7:
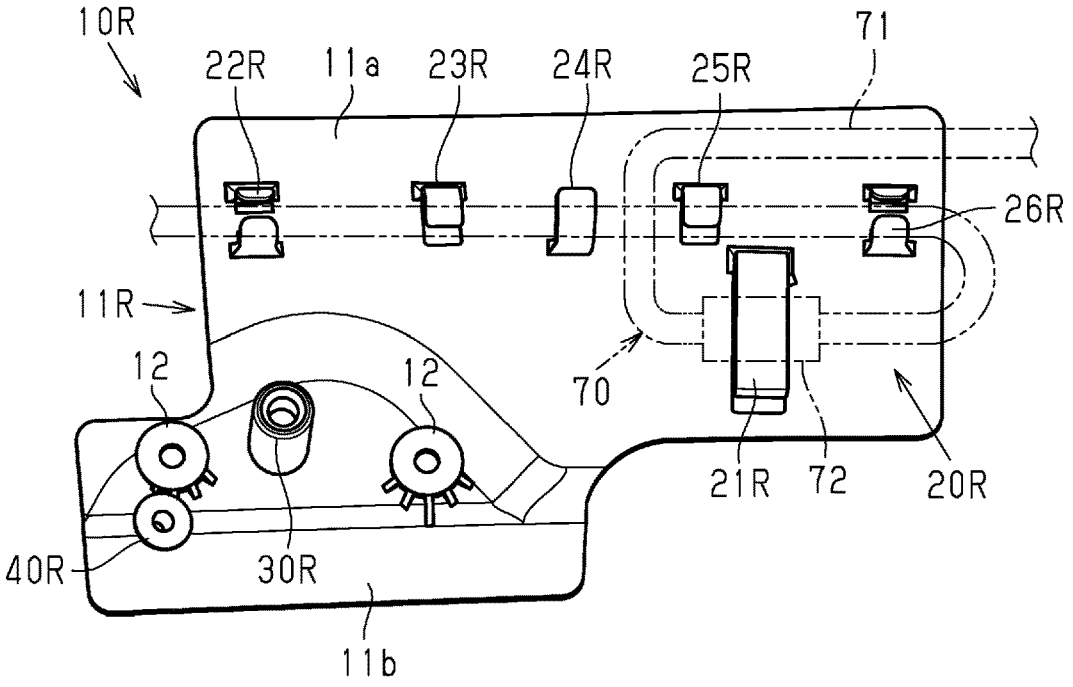
FIG. 7 is a front view of the harness bracket of FIG. 3 to which a harness is attached.

The operation of the helmet 1 will now be described with reference to FIG. 7. The procedure for attaching the harness bracket 10R, the liner 50R, and the cheek pad 60R to the helmet body 2 will be described in detail below. The harness bracket 10L, the liner 50L, and the cheek pad 60L are attached to the helmet body 2 through the same procedures. In FIG. 7, the left direction in the drawing is the front as viewed from the wearer of the helmet 1, and the right direction in the drawing is the rear as viewed from the wearer of the helmet 1.

First, the fixing portions 12 of the harness bracket 10R are fastened by screws to the helmet body 2. This fixes the harness bracket 10R to the helmet body 2. As described above, the means for fixing the harness bracket 10R to the helmet body 2 does not need to be screws. Any fixing means may be used to attach the harness bracket 10R to the helmet body 2.

Then, as shown in FIG. 7, a harness 70 that is to be connected to electronic devices installed in the helmet 1 is attached to the harness bracket 10R. Specifically, the harness 70 includes a connection member 72 that relays wires 71 connected to the corresponding electronic devices. In one example, the connection member 72 is a relay connector. The wire 71 is supported by the wire supports 22R to 26R and positioned relative to the base 11R. The connection member 72 is supported by the connection member support 21R and positioned relative to the base 11R.

The harness support 20R is located upward from the liner support 30R and the pad support 40R so that the harness 70 is laid out in a space above the liner support 30R and the pad support 40R.

Then, the liner 50R is attached to the harness bracket 10R. Specifically, the liner support 30R is inserted into the insertion hole 51 so that the liner 50R is positioned and fixed to the base 11R. An electronic device is arranged in the holder 52 and the wire 71 is arranged in the wire groove 53.

Then, the cheek pad 60R is attached to the harness bracket 10R, the liner 50R, and the helmet body 2. Specifically, the second engagement portion 65*b* of the cheek pad 60R is first held by the holding portion (not shown) arranged in the helmet body 2. Then, the fixing piece 65 of the cheek pad 60R is inserted between the helmet body 2 and the liner 50R from below the helmet body 2, and the first engagement portion 65*a* is engaged with the engaged portion 41. Here, the pad support 40R is located downward from the harness support 20R and the liner support 30R so that the first engagement portion 65*a* is easily engaged with the engaged portion 41. This improves the working efficiency for attaching the cheek pad 60R.

Further, the female buttons 63 of the cheek pad 60R are engaged with the male buttons of the liner 50R so that the body 61 is fixed to the inner surface of the liner 50R. The harness bracket 10R, the liner 50R, and the cheek pad 60R are attached to the helmet body 2 through the above procedures.

Advantages of the Embodiment

The above embodiment has the following advantages.

(1) The arrangement of the harness supports 20L, 20R, the liner supports 30L, 30R, and the pad supports 40L, 40R on the bases 11L, 11R sets the relative positions of the harness 70, the liners 50L, 50R, and the cheek pads 60L, 60R. This avoids entrapment of the wire 71 of the harness 70 when attaching the liners 50L, 50R and the cheek pads 60L, 60R. As a result, breakage of the wire 71 of the harness 70 is avoided.

(2) The liner supports 30L, 30R are located downward from the harness supports 20R so that the liners 50L, 50R are attached at locations spaced apart from the wire 71 that is supported by the harness supports 20L, 20R. This avoids entrapment of the wire 71 of the harness 70 when attaching the liners 50L, 50R.

(3) The pad supports 40L, 40R are located downward from the harness supports 20R so that the cheek pads 60L, 60R are attached at locations spaced apart from the wire 71 that is supported by the harness supports 20L, 20R. This avoids entrapment of the wire 71 of the harness 70 when attaching the cheek pads 60L, 60R.

(4) The harness supports 20L, 20R are located upward from the liner supports 30L, and the pad supports 40L, 40R so that the harnesses 70 are laid out in the spaces above the liner supports 30L, 30R and the pad supports 40L, 40R.

(5) The pad supports 40L, 40R are located downward from the harness supports 20R and the liner supports 30L, 30R. This improves the working efficiency for attaching the cheek pads 60L, 60R.

(6) The connection member supports 21L, 21R, the liner supports 30L, 30R, and the pad supports 40L, 40R, are arranged at different positions in the vertical direction and the circumferential direction of the helmet body 2. This improves the working efficiency for attaching the liners 50L, 50R and the cheek pads 60L, 60R.

The above embodiment may be modified as follows.

In the above embodiment, the connection member supports 21L, 21R, the liner supports 30L, 30R, and the pad supports 40L, 40R, are arranged at different positions in the vertical direction and the circumferential direction of the helmet body 2. The arrangement of the connection member supports 21L, 21R, the liner supports 30L, 30R, and the pad supports 40R may be changed as long as the liners 50L, 50R and the cheek pads 60L, 60R are attached in a preferred manner. For example, the connection member supports 21L, 21R and the pad supports 40L, 40R may be arranged at the same location in the circumferential direction of the helmet body 2. In this case, the connection member supports 21L, 21R and the pad supports 40L, 40R are sufficiently separated in the vertical direction, thereby improving the working efficiency for attaching the cheek pads 60L, 60R.

In the above embodiment, the pad supports 40L, 40R are located downward from the harness supports 20L, 20R and the liner supports 30L, 30R. Alternatively, the pad supports 40L, 40R may be arranged at the same height as the liner supports 30L, 30R. In this case, the liner supports 30L, 30R and the pad supports 40L, 40R are sufficiently separated in the circumferential direction of the helmet body 2, thereby improving the working efficiency for attaching the cheek pads 60L, 60R.

In the above embodiment, the harness supports 20L, 20R are located upward from the liner supports 30L, 30R and the pad supports 40L, 40R. Alternatively, the harness supports 20L, 20R may be arranged at the same height as the liner supports 30L, 30R. Further, the harness supports 20L, 20R may be arranged at the same height as the pad supports 40L, 40R. In these cases, the harness supports 20L, 20R are sufficiently separated from the liner supports 30L, 30R and the pad supports 40L, 40R in the circumferential direction of the helmet body 2, thereby avoiding entrapment of the wire 71 when attaching the liners 50L, 50R and the cheek pads 60L, 60R.

The liners 50L, 50R may have any shape as long as the liners 50L, 50R can be attached to the liner supports 30L, 30R. For example, the liners 50L, 50R do not need to be plane-symmetrical to each other. The cheek pads 60L, 60R may have any shape as long as the cheek pads 60L, 60R can be attached to the pad supports 40L, 40R. For example, the cheek pads 60L, 60R do not need to be plane-symmetrical to each other.

The shapes and the arrangement of the parts that form the harness supports 20L, 20R may be determined based on the shapes of the wire 71 and the connection member 72 of the harnesses 70 and the layout of the harnesses 70. In the above embodiment, the connection member support 21L and the connection member support 21R have different shapes. Alternatively, the connection member support 21L and the connection member support 21R may have the same shape. Further, the harness supports 20L, 20R may be plane-symmetrical to each other.

The arrangement of the harness supports 20L, 20R, the liner supports 30L, 30R, and the pad supports 40L, 40R on the harness brackets 10L, 10R may differ from the present embodiment as long as the entrapment of the wire 71 is avoided when attaching the liners 50L, 50R and the cheek pads 60L, 60R. For example, the harness brackets 10L, 10R may be plane-symmetrical to each other.

In the above embodiment, the helmet 1 is a full-face helmet. Alternatively, the helmet 1 may be a flip-up helmet with a chin guard that can be raised, an open face helmet, a helmet with a removable chin guard, or a convertible helmet with a chin guard that is pivoted and fixed to the back of the helmet.

The invention claimed is:

1. A harness bracket configured to be attached to a helmet body of a helmet, the harness bracket comprising:

a base configured to be attached to the helmet body, wherein the base includes a first support configured to support a harness connected to electronic devices installed in the helmet, the first support being configured to position the harness on the base, a second support configured to support a liner being an interior member of the helmet, the second support being configured to position the liner on the base by being inserted into an insertion hole of the liner, and a third support configured to support a cheek pad being an interior pad of the helmet and arranged at an inner side of the liner, the third support being configured to position the cheek pad on the base by engaging with an engagement portion of the cheek pad, wherein the first support includes more than one wire supports configured to support a wire of the harness, wherein the wire supports are aligned from front to rear, as viewed from a wearer of the helmet, and the wire supports are configured to support the wire upward and/or downward.

2. The harness bracket according to claim 1, wherein the first support is located upward, as viewed from a wearer of the helmet, from the second support.

3. The harness bracket according to claim 1, wherein the first support is located upward, as viewed from a wearer of the helmet, from the third support.

4. The harness bracket according to claim 1, wherein the third support is located downward, as viewed from a wearer of the helmet, from the first support and the second support.

5. The harness bracket according of claim 1, wherein the first support further includes a connection member support configured to support a connection member of the harness wherein the connection member support includes two holding projections configured to hold the connection member therebetween, thereby supporting the connection member.

6. The harness bracket according to claim 5, wherein the connection member support, the second support, and the third support are arranged at different positions in a vertical direction and a circumferential direction of the helmet body.

7. A helmet comprising a helmet body and a harness bracket configured to be attached to the helmet body, wherein the harness bracket includes a base configured to be attached to the helmet body, and the base includes a first support configured to support a harness connected to electronic devices installed in the helmet, the first support being configured to position the harness on the base, a second support configured to support a liner being an interior member of the helmet, the second support being configured to position the liner on the base by being inserted into an insertion hole of the liner, and a third support configured to support a cheek pad being an interior pad of the helmet and arranged at an inner side of the liner, the third support being configured to position the cheek pad on the base by engaging with an engagement portion of the cheek pad, wherein the first support includes more than one wire supports configured to support a wire of the harness, wherein the wire supports are aligned from front to rear, as viewed from a wearer of the helmet, and the wire supports are configured to support the wire upward and/or downward.

8. The helmet according to claim 7, wherein the first support further includes a connection member support configured to support a connection member of the harness, wherein the connection member support includes two holding projections, and the two holding projections hold the connection member therebetween, thereby supporting the connection member.

9. The helmet according to claim 8, wherein the connection member support, the second support, and the third support are arranged at different positions in a vertical direction and a circumferential direction of the helmet body.

* * * * *